US008516729B2

(12) United States Patent
Hayes et al.

(10) Patent No.: US 8,516,729 B2
(45) Date of Patent: Aug. 27, 2013

(54) REDUCED LETHALITY GUN

(75) Inventors: John Hayes, Tequesta, FL (US); David J. W. Lovinger, Jupiter, FL (US)

(73) Assignee: Brejon Holdings (BVI), Ltd., Tortola (VG)

( * ) Notice: Subject to any disclaimer, the term of this patent is extended or adjusted under 35 U.S.C. 154(b) by 158 days.

(21) Appl. No.: 13/102,618

(22) Filed: May 6, 2011

(65) Prior Publication Data

US 2012/0279106 A1 Nov. 8, 2012

(51) Int. Cl.

| | |
|---|---|
| ***F41A 19/06*** | (2006.01) |
| ***F41A 19/10*** | (2006.01) |
| ***F41A 19/18*** | (2006.01) |
| ***F41A 21/06*** | (2006.01) |
| ***F41A 21/18*** | (2006.01) |
| ***F41F 1/08*** | (2006.01) |

(52) U.S. Cl.
USPC ..... 42/69.01; 42/76.01; 42/78; 89/1.41

(58) Field of Classification Search
USPC ..... 42/69.01, 76.01, 78; 89/1.41, 14.7
See application file for complete search history.

(56) References Cited

U.S. PATENT DOCUMENTS

| | | | | | |
|---|---|---|---|---|---|
| 1,348,035 | A | | 7/1920 | Mossberg | |
| 3,299,558 | A | * | 1/1967 | Karl | 42/76.02 |
| 3,352,046 | A | * | 11/1967 | Warner et al. | 42/106 |
| 3,517,585 | A | * | 6/1970 | Slade | 89/16 |
| 3,720,133 | A | * | 3/1973 | Jampy et al. | 89/126 |
| 3,783,787 | A | | 1/1974 | Thornley et al. | |
| 3,791,297 | A | | 2/1974 | McKee | |
| 4,116,109 | A | | 9/1978 | Ervine | |
| 4,400,900 | A | * | 8/1983 | Hillberg et al. | 42/69.01 |
| 4,422,382 | A | | 12/1983 | Marz | |
| 4,424,638 | A | * | 1/1984 | Hillberg | 42/69.01 |
| 4,625,443 | A | * | 12/1986 | Beretta | 42/42.03 |
| 4,722,148 | A | * | 2/1988 | Walker | 42/69.01 |
| 4,934,086 | A | * | 6/1990 | Houde-Walter | 42/115 |
| 5,221,809 | A | | 6/1993 | Cuadros | |
| 5,450,795 | A | | 9/1995 | Adelman | |

(Continued)

FOREIGN PATENT DOCUMENTS

| | | |
|---|---|---|
| EP | 0209248 | 1/1987 |
| GB | 2062818 | 5/1981 |
| WO | WO2007066323 | 6/2007 |

*Primary Examiner* — Bret Hayes
(74) *Attorney, Agent, or Firm* — McHale & Slavin, P.A.

(57) ABSTRACT

A gun that has a plurality of frangible barrels. At the proximal end of each barrel is a chamber that receives a cartridge. The cartridge has a reduced charge as compared to a conventional cartridge. Each barrel may have an inner sleeve formed from a malleable material. The out member of each barrel is comprised of a rigid material such as, but not limited to, a filled plastic. The inner sleeve is rigid enough to withstand the pressure of the reduced charge cartridge when fired, but is malleable enough to expand from the pressure generated by a standard charge cartridge. When the inner sleeve expands, the outer member fragments and destroys the weapon. The expansion of the inner sleeve and fragmentation of the outer member upon firing a standard charge reduces the propelling force in the bullet. As a result, the weapon is destroyed and the bullet is fired with a greatly reduced force. The barrels on the gun don not rotate. The hammer is mounted in a revolving mechanism that is rotated in a circular path from one barrel to the next when the trigger is pulled. Pulling the trigger also compresses and then releases a revolving member that forces the hammer into contact with one of the firing pins.

17 Claims, 7 Drawing Sheets

(56) References Cited

U.S. PATENT DOCUMENTS

| | | | | |
|---|---|---|---|---|
| 5,490,343 | A * | 2/1996 | Cory et al. | 42/70.08 |
| 5,698,815 | A | 12/1997 | Ragner | |
| 5,831,199 | A | 11/1998 | McNulty, Jr. et al. | |
| 6,302,027 | B1 | 10/2001 | Compton et al. | |
| 6,374,742 | B1 | 4/2002 | Brunn et al. | |
| 6,543,174 | B2 * | 4/2003 | O'Dwyer | 42/76.01 |
| 6,655,294 | B1 | 12/2003 | Kerr | |
| 6,782,828 | B2 | 8/2004 | Widener | |
| 6,862,995 | B2 | 3/2005 | Kerr | |
| 6,899,034 | B1 | 5/2005 | Glover et al. | |
| 7,089,864 | B2 | 8/2006 | Brunn et al. | |
| 7,204,191 | B2 | 4/2007 | Wiley et al. | |
| 7,614,349 | B2 | 11/2009 | Puskas et al. | |
| 8,061,274 | B1 * | 11/2011 | Hayes et al. | 102/449 |
| 2001/0045173 | A1 | 11/2001 | Gibson et al. | |
| 2002/0157526 | A1 | 10/2002 | O'Dwyer | |
| 2003/0094113 | A1 | 5/2003 | Warnagiris et al. | |
| 2003/0129138 | A1 | 7/2003 | Loghman-Adham | |
| 2004/0255813 | A1 | 12/2004 | Kerr | |
| 2005/0066841 | A1 | 3/2005 | Vasel et al. | |
| 2005/0188886 | A1 | 9/2005 | Vasel et al. | |
| 2005/0193689 | A1 | 9/2005 | Basque | |
| 2005/0229807 | A1 | 10/2005 | Brock et al. | |
| 2011/0072704 | A1 | 3/2011 | Teach, Jr. et al. | |

* cited by examiner

REDUCED LETHALITY GUN

FIELD OF THE INVENTION

This invention relates to weapons and more particularly to a firearm that can be loaded with a plurality of cartridges each of which is capable of incapacitating an individual without the use of potentially lethal force. The ability to limit a fire arms capability to less than lethal under all circumstances is problematic. If the weapon is intended to fire less than lethal type cartridges it still may fall into wrong hands and be used as a more lethal weapon to fire more powerful cartridges.

BACKGROUND OF THE INVENTION

Law enforcement has long operated with what is called a "continuum of force". It provides guidance to officers for selecting the type of weaponry to use in a variety of situations. The continuum normally begins with verbal commands. Should the subject or subjects not respond, the continuum may advise the next level of force until lethal force is absolutely necessary. In situations such as riots, prisons disturbances, hostages rescues, and the like the continuum of force is utilized. However, officers have long recognized that a wide and dangerous gap exists in the range of tools available to them. In the past, officers had very few options for riot control after verbal commands. Common tactics included advancing walls of officers with batons, or a charge by officers using flats of sabers. However, these tactics still resulted in serious bodily injury due to trampling or excessive police force as they march through crowds; furthermore, innocent civilians were at times injured by inadvertent striking or trampling. It was often that the tactics used were either too weak or too strong a response to some situations. As a result the use of high-pressure fire houses, electroshock weapons, and non-lethal chemical agents (such as tear gas and offensive odor canisters) were employed to disperse a crowd. Unfortunately, the discretion of officers in utilizing these weapons and tactics led to either misuse by officers or insufficient force applied by officers to maintain peace.

While law enforcement has long recognized the gap in the force of continuum, the concept is relatively new to the military. More and more, military forces are being deployed to situations involving peacekeeping and noncombat operations. A solider must be equipped and trained for peacekeeping and humanitarian assistance operations. In certain situations, law enforcement officers and military soldiers are required to use force to control crowds or individuals, as such less than lethal means are recommended by the force continuum. Less than lethal weapons and tactics are intended to be unlikely to kill or cause great bodily injury, thus minimizing civilian casualties and providing soldiers or officers with an alternative to lethal force.

DESCRIPTION OF THE PRIOR ART

A less than lethal projectile, provided in a less than lethal weapon, assures that the requisite less than lethal consequence exists and minimizes the soldiers or officers subjectivity in determining the amount of force to use when necessary. Thus heightening the margin of safety for civilians in a riot without minimizing the primary objective: to temporarily incapacitate, confuse, delay, or restrain. One type of projectile commonly used is a beanbag. For instance, U.S. Pat. No. 6,655,294 discloses a beanbag suitable for installation in a cartridge or shell of a projectile found in a conventional handgun and the process for making the same. The beanbags are fabric bags that contain lead shot or pellets. The round is intended to flatten on impact, hitting face on, thereby spreading its energy over a larger area. When the bag leaves the gun it unrolls and rotates into the flat orientation to strike the target. Unfortunately, if the bag hits before it is completely unfurled or an edge-on orientation, the full force of the impact is distributed over a smaller area, causing more damage. Furthermore, because of their shape (square, rectangular, or circular) the bags are regarded as wildly inaccurate and have been known to veer off course.

Another type of impact device launched from a cartridge shell is a less than lethal projectile. For instance, U.S. Pat. No. 7,089,864 discloses a projectile launched from a weapon shell required at impact to have a low lethality consequence, in which the projectile is fitted in the shell in a shape characterized by a blunt or flat end in the direction of flight. Unfortunately, this low lethality projectile is susceptible to being unstable during its path of flight due to its relatively low weight and slower rate of speed. Furthermore, the projectile is only capable of being fired from a 37 mm or 40 mm weapon shell thus limiting the selection of munitions available to the officer or soldier. In addition, the disadvantages associated with the low lethality projectile also include the method of producing the same. U.S. Pat. No. 6,374,742 discloses a method of shaping a projectile comprising the steps of filling an unbounded rear end of an unfilled tubular sock having a closed front end, forming folds in the tubular sock immediately forward of the rear opening, and manually inserting the tubular sock into a projectile compartment of a 37 mm or 40 mm weapon shell. In so far as the method of sealing the projectile is disclosed as a fold, it is possible that upon impact the projectile may bust, spilling the rubber pellets. Therefore a more reliable seal is desired. Additionally, the method disclosed is not conducive for mass production of the device because it cannot be manufactured on an automated production line. In point of fact, many of the steps of production in the '742 patent involve manual labor.

U.S. Pat. No. 7,614,349 discloses a high-density composite material and its use in the manufacture of less-lethal ammunition projectiles. The composite ammunition projectile material is produced from a compact mixture of fine iron powder, a highly damping inert, non toxic elastomer and an insert of non-toxic thermoplastic elastomer. The composite ammunition projectile material is first blended, then the projectile is injection molded or compression molded. The density of the composite ammunition projectile is adjustable in terms of the ratio of iron powder to elastomer to thermoplastic elastomer block co-polymer, but a minimum density of 2.4 $gcm^{-3}$ is preferred. A blend comprising an elastomer and a thermoplastic elastomer with low creep is also disclosed.

While these prior art devices may be suitable for the particular purpose to which they address, they would be unsuitable for the purposes of the present invention as heretofore described. As a consequence of these aforementioned problems, it is an objective of the present invention to provide a less than lethal fire arm.

SUMMARY OF THE INVENTION

The invention is directed to a fire arm that will fire low power cartridges, and will be destroyed when a full power cartridge is loaded into the weapon and fired. Should a full powered cartridge fired from the weapon the weapon will be destroyed and the velocity of the bullet will be significantly reduced.

The firearm is a gun having a plurality of frangible barrels arranged in a two by two pattern. At the proximal end of each barrel is a chamber that receives a cartridge. Each cartridge contains a charge that is less than a conventional standard charge. Each barrel may include an inner sleeve formed out of a deformable metallic metal. The outer sleeve is comprised of a rigid material such as, but not limited to, a filled plastic. The inner sleeve is sufficiently strong to withstand the pressure of a reduced charge that is fired with the weapon, but will deform when exposed to the pressure of the firing of a standard charge. When the inner sleeve expands from the pressure exerted by the standard charge, the outer member will fragment, thereby destroying the firearm. Simultaneously, the expansion of the inner sleeve and fragmentation of the outer member of the barrel will reduce the propelling force on the bullet. Therefore, an attempt to use a standard cartridge within this weapon will result in the destruction of the weapon as well as the firing of a bullet with greatly reduced force.

The plurality of barrels of the firearm are stationary and do not rotate. The hammer of the weapon is mounted on a revolving mechanism that is rotated in a circular pattern from one barrel to the next by pulling the trigger. As the trigger is pulled backwards a trigger latch will catch and then release the revolving mechanism via lead-in and lead-out ramps formed on the revolving member. Pulling the trigger will pull the revolving mechanism rearward and compress a drive spring which in turn will cause the revolving mechanism to move forward thereby causing the hammer to impact the firing pin and then into primer of the cartridge. When the trigger is pulled all the way, the firing spring is fully compressed, and the revolving mechanism has moved the hammer part way to the next barrel. The trigger latch mechanism then releases the revolving mechanism. As the revolving mechanism is moved forward by the spring, it completes its rotation to the next barrel and the hammer impacts the firing pin which in turn fires the charge. The rotation of the revolving mechanism is provided by a helical cam mechanism. A cam follower in the revolving mechanism follows the helical path in the revolving mechanism is pulled back by the trigger to rotate the firing pin part way to the next barrel. When the trigger latch releases the revolving mechanism, the spring forces the revolving mechanism forward and the cam follower, riding in the second helical groove in the cam completes the rotation to the next barrel and the firing pin then fires the cartridge. The inertia of the revolving mechanism is required in order to store the spring energy as kinetic energy but the spring drives the revolving mechanism all the way forward. A weaker spring that is also compressed by the revolving member during firing is strong enough to pull the firing pin back after firing so that it will not fire a round when the firearm is closed after loading.

Accordingly, it is an objective of the instant invention to provide a gun that will fire low power cartridges, but be destroyed when a full power cartridge is fired.

It is a further objective of the instant invention that even if a full power cartridge is attempted to be fired from the gun the bullet will be fired with a reduced velocity even as the gun is destroyed by the firing.

It is yet another objective of the instant invention to provide a less than lethal hand gun that is capable of firing a plurality of rounds between reloads.

It is a still further objective of the invention to provide a less than lethal weapon that is intended to be unlikely to kill or cause great bodily injury, thus minimizing civilian casualties and providing soldiers or officers with an alternative to lethal force.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
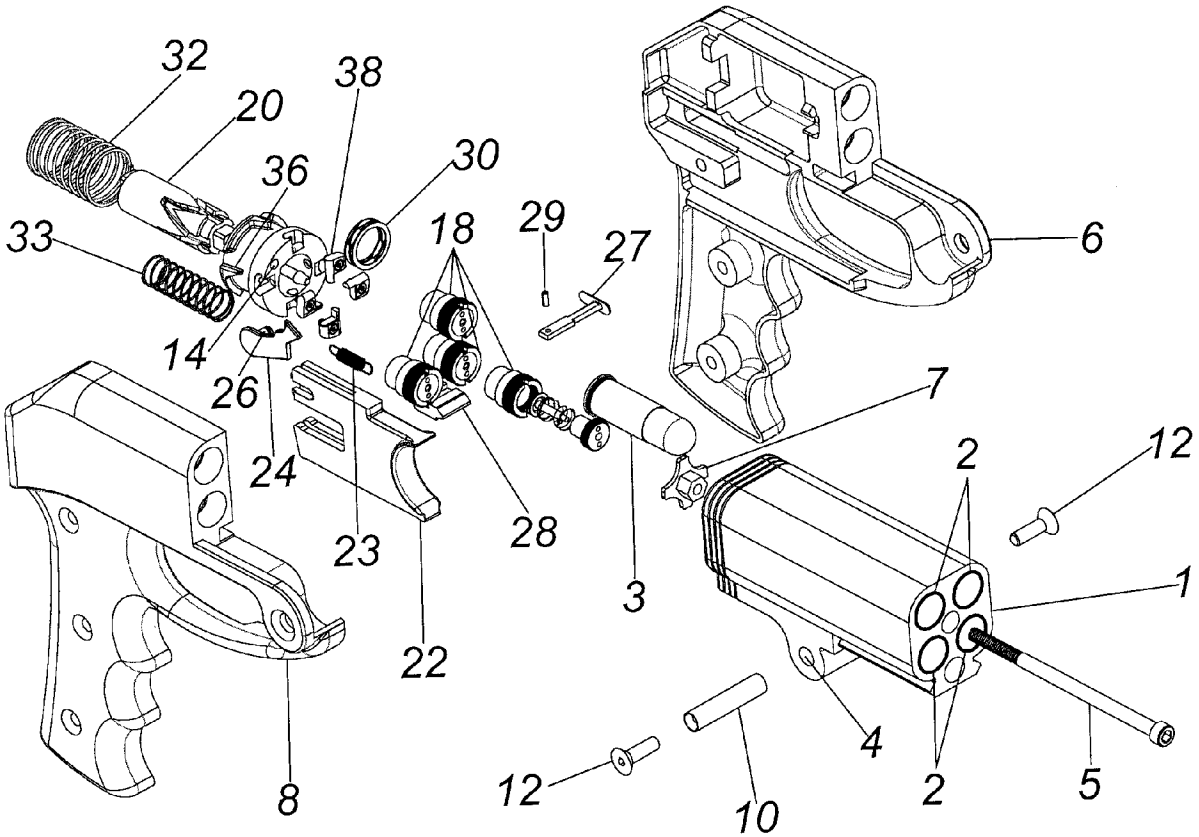
FIG. 1 is a side view of the gun shown in an exploded view for clarity.

The firearm of the instant invention includes a plurality of barrels. As shown in the exploded side view of FIG. 1 it includes a molded barrel member 1 that includes four separate barrels. The molded barrel member 1 is comprised of a rigid material such as, but not limited to, a filled plastic (i.e. glass or nylon fibers). Each barrel within the barrel member 1 may include a barrel sleeve 2 that is formed from a deformable metal such as a malleable metal. The outer barrel member 1 includes a mounting aperture 4 sized and configured to mate with apertures formed in the right and left main housing parts 6 and 8. A barrel hinge pin 10 pivotally connects the molded barrel member 1 and the two main housing parts 6 and 8. The hinge pin 10 is secured in place to molded barrel member 1 and the main housing parts 6 and 8 with hinge pin fasteners 12. Attached to barrel member 1 is a socket cap screw 5 and an ejector plate 7. Also shown in FIG. 1 is a cartridge 3. A hammer 14 is carried by a revolving and reciprocating mechanism 16. The hammer 14 moves in a circular path and sequentially impacts one of the four firing pins each located with firing pin assemblies 18 in successive order. A stationary helically slotted cam 20, which is held in position between main housing parts 6 and 8, is in operative engagement with the revolving mechanism 16 so as to affect a rotary and reciprocating motion of revolving mechanism 16. A sliding trigger 22 is mounted for reciprocating movement with the main housing parts 6 and 8. The sliding trigger 22 includes a trigger latch 24 mounted on a hinge pin 26. The latch 24 will catch and release the revolving mechanism 16. A barrel lock 28 is used to lock and unlock the barrel member 1. Also shown in FIG. 1 is an extension spring 23, a thumb lock 27, and a spring pin barrel lock 29. A wave spring 30 urges the revolving member 16 rearwards to position the hammer 14 away from the firing pins when the revolving member 16 is in a rest position. A drive spring 32 is compressed as the sliding trigger 22 and the revolving member 16 are moved rearwards until such time as the revolving member 16 is released from trigger latch 24 thereby releasing the energy stored in the compressed drive spring 32. The sliding trigger 22 is biased into a rest position by a return spring 33 positioned between the housings and the sliding trigger 22.

Figure 2:
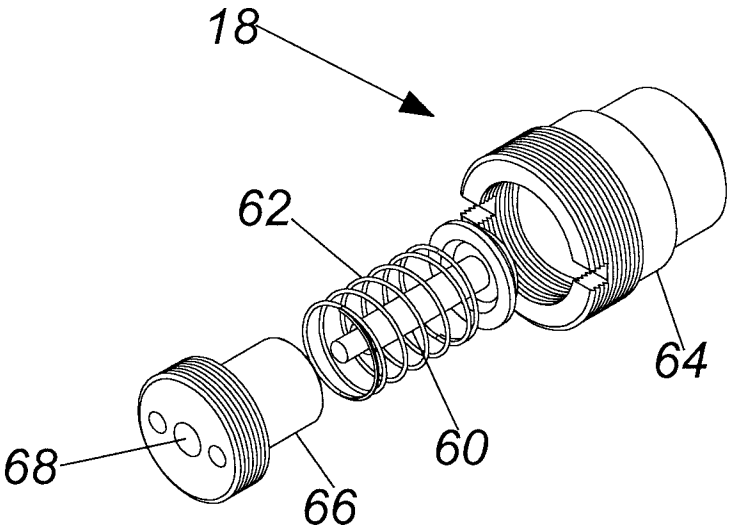
FIG. 2 is an exploded perspective view of a firing pin assembly.

FIG. 2 is an exploded perspective view of one of the four firing pin assemblies 18. Two of the assemblies 18 are positioned within bores formed in the right main housing 6 and the other two firing pin assemblies are positioned within the left main housing assembly 8. Each assembly 18 includes a firing pin 60 that is biased to a return position by a firing pin spring 62. The firing pin 60 which is generally cylindrical in construction includes an enlarged end that is impacted by the hammer 14. The assembly 18 includes a firing pin housing cap 64 and firing pin housing 66. Once assembled, the firing pin spring 62 bears against the enlarged end of the firing pin and the firing pin housing 66 to urge the firing pin 60 into a retracted position. When the hammer 14 impacts the enlarged area of the firing pin 60 through an opening in the firing pin housing cap 64 the firing pin 60 will be moved through opening 68 formed in firing pin housing 66 and impact the primer of the cartridge 3.

Figure 3C:
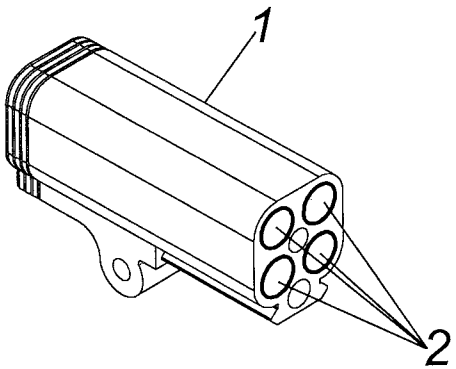
FIG. 3C is a perspective view of the molded barrel and sleeve.
Figure 3A:
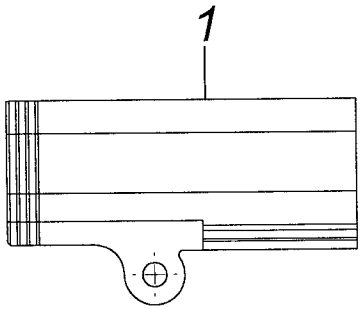
FIG. 3A is a side view of the molded barrel and sleeve.
Figure 3B:
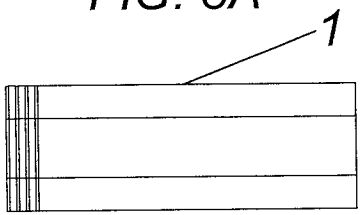
FIG. 3B is a top view of the molded barrel and sleeve.
Figure 3D:
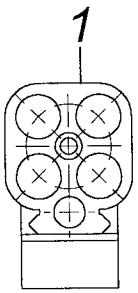
FIG. 3D is an end view of the molded barrel.

FIG. 3A is a side view of the molded barrel 1, FIG. 3B is a top view of the molded barrel 1 having four separate barrels, each barrel can be optionally fitted with a sleeve 2, and FIG. 3C is a perspective view of the molded barrel 1 and FIG. 3D is an end view of the molded barrel 1.

Figure 4B:
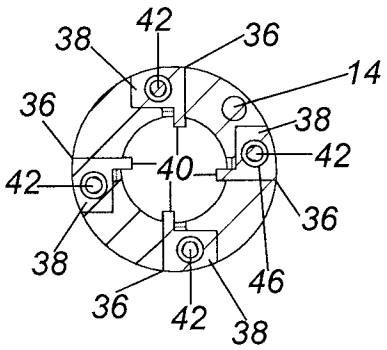
FIG. 4B is a cross sectional end view of the revolving mechanism taken along line B in FIG. 4A.
Figure 4C:
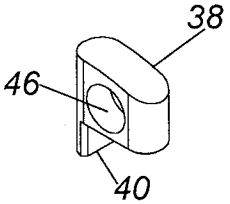
FIG. 4C is a single shaped cam pin.
Figure 4A:
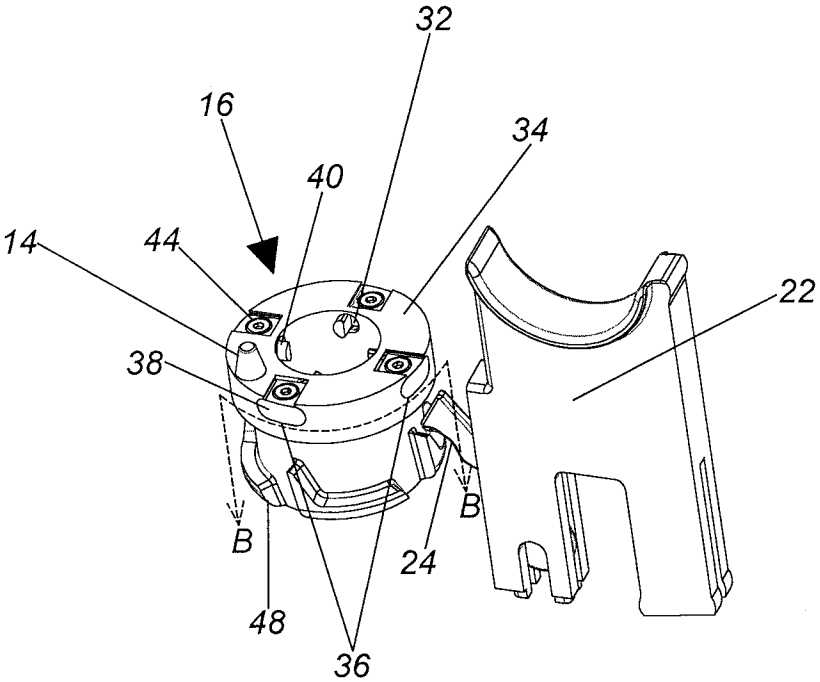
FIG. 4A is a perspective side view of the revolving mechanism.

FIG. 4A is a perspective side view of the revolving mechanism 16, FIG. 4B is a cross sectional end view of the revolving mechanism 16 and FIG. 4C is a single shaped cam pin. As shown therein revolving member 16 carries a hammer 14 on an end face 34 of revolving member 16. The revolving member 16 moves in a revolving and reciprocating motion such that the hammer 14 will move in a circular path sequentially impacting one of the firing pins associated with each barrel of the barrel member 1 in successive order in response to successive pulls of the sliding trigger 22. Four bores 36 are circumferentially located about the revolving member 16 spaced and are equidistant from one another. Located in each bore 36 is a cam element 38 having a cam pin 40. Cam elements 38 are retained in the revolving member 16 using fasteners 42 that pass through bores 44 in revolving member 16 and bore 46 in the cam element 38. The four cam pins 40 are directed radially inward on revolving member 16 and are in operative engagement with the stationary helically slotted cam 20. As the sliding trigger 22 reciprocates within the main housing parts 6 and 8 the trigger latch 24 mounted on a hinge pin 26 will catch are release revolving member 16 via lead-in and lead-out ramps 48. The lead-in and lead-out ramps 48 on the revolving member 16 provide additional bias to force the revolving member follower cam pins 40 to travel down the desired cam profile path instead of trying to return down the previous path.

FIG. 4B is a cross sectional end view of the revolving mechanism taken along line B in FIG. 4A. As shown in this figure revolving mechanism 16 includes four bores 36, each containing a cam element 38. Each cam element 38 includes a radially directed inward cam pin 40. The cam elements are retained in revolving member 16 by a fastener 42 positioned within the revolving member 16 and a bore 46 with within the cam element 38.

FIG. 4C is a perspective view of a single cam element 38 having a cam pin 40 and bore 46 that is used to secure the cam element 38 to the revolving member 16.

Figure 6:
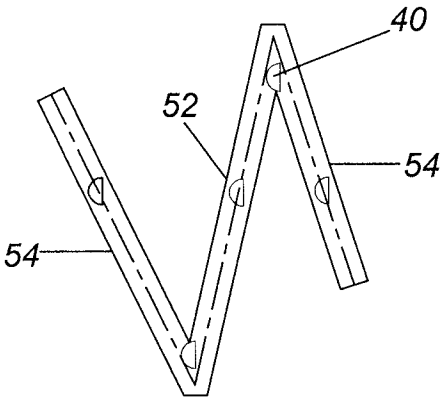
FIG. 6 is a diagrammatic representation of the relationship between a pin on the revolving mechanism and the slot of the helically slotted cam as the revolving mechanism is rotated.
Figure 5:
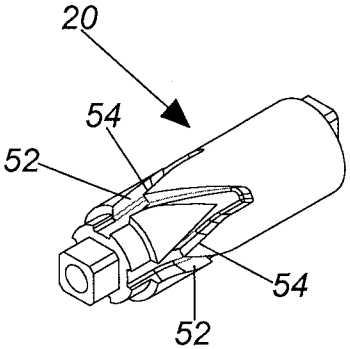
FIG. 5 is a perspective view of the stationary helically slotted cam.

FIG. 5 is a perspective view of the stationary helically slotted cam 20. The cam pins 40 are in operative engagement with a helical groove on helically slotted cam 20. The helically slotted cam 20 includes four pairs of alternating grooves 52 and 54. Grooves 54 engage cam pins 32 as the revolving member 16 is urged towards impact with the firing pins and grooves 52 engage cam pins 40 while the revolving member 16 is pulled back during the trigger firing implementation. The angles of the groves 52 and 54 normal to the direction of travel of the revolving member 16 are balanced to reduce energy losses during the firing and trigger pulling stages to minimize the required cylinder spring force. The preferred angles were approximately 60 and 30 degrees, but other angles could be used dependent upon other system configurations FIG. 6 is a diagrammatic representation of the relationship between a pin 40 on the revolving mechanism and the slots 54 and 52 of the helically slotted cam 20 as the revolving mechanism 16 is rotated. Each of cam pins 40 has a semi circular cross section to facilitate the travel of the pins 40 as they move about the stationary helically slotted cam 20. The cam pins are semi-circular so that the non-contact side of the cam slot profile can be narrowed. The non-contact side has to be narrowed so that on the unguided re-engagement of the pin (at trigger release, and on the start of the trigger pull) the point of the slot the pin is traveling axially to engage is on the side of the pin to guide it up the correct path. If the pin was full diameter, the slot would need to be wider, and the pin would hit the slot point during trigger pull and release in such as fashion as to travel back upon the original path instead of traveling into the next slot. The lead-in and lead out ramps 48 on the revolving member 16 also work to bias the cam pins 40 to the correct path in the slots, but the cam pin profile is used to enable the use of a narrower slot and to prevent the pins from traveling down the wrong path.

Figure 7:
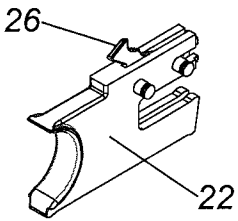
FIG. 7 is a perspective view of the trigger mechanism.

FIG. 7 is a perspective view of the sliding trigger 22 which is mounted for reciprocating movement with the main housing parts 8 and 9. The sliding trigger 22 includes a trigger latch 24 mounted on a pin 26. The trigger latch 24 will catch and release the revolving mechanism 16.

Figure 8:
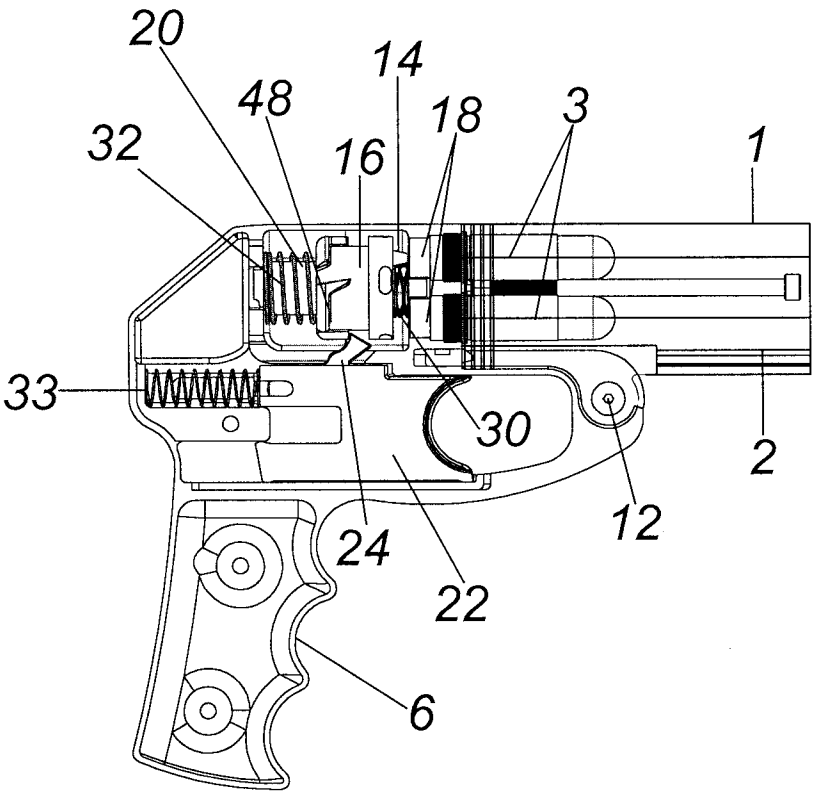
FIG. 8 is a side view of the gun with parts of the housing removed with the trigger is a non actuated position.
Figure 9:
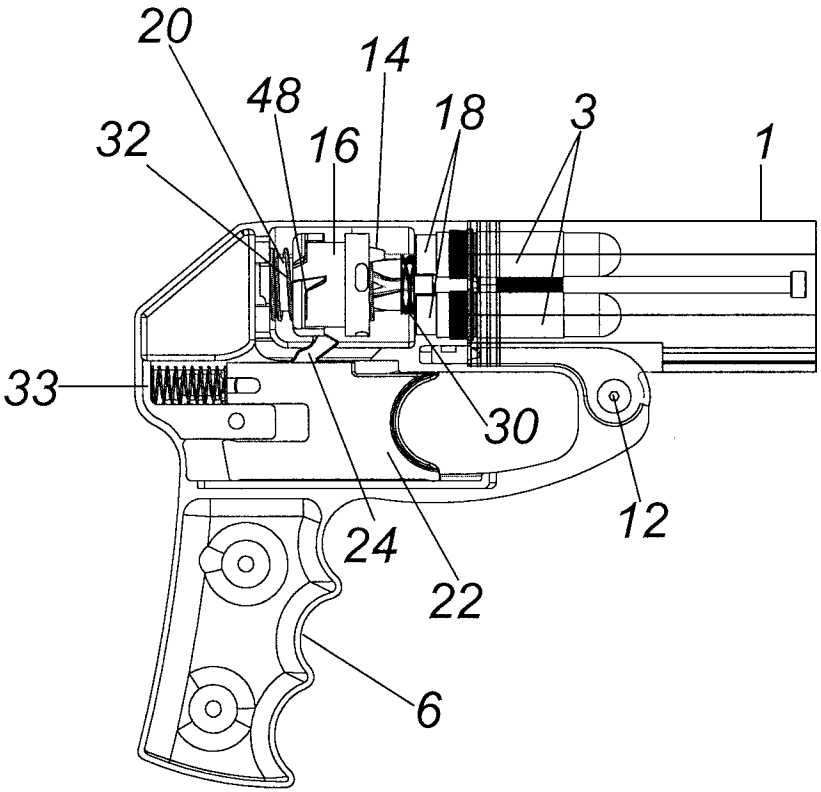
FIG. 9 is a side view of the gun with parts of the housing removed with the trigger pulled back just prior to firing.

FIGS. 8 and 9 are a side views of the gun with parts of the housing removed. FIG. 8 shows the sliding trigger 22 in a non pulled back state and FIG. 9 shows the sliding trigger 22 is the pulled back position. As shown, the gun includes barrel member 1 that is pivotally attached to the main housing parts via a pin 10 and hinge pin fasteners 12. The rear end of the barrel member is configured to receive four cartridges 3. A hammer 14 is carried by revolving member 16. Revolving member 16 will rotate and reciprocate on helically slotted member 20 as a result of the operative engagement between cam pins 40, included on cam elements 38, and grooves 52 and 54 formed on helically slotted member 20. As the sliding trigger 22 is pulled rearwards trigger latch 24 will catch and release the revolving mechanism 16 via lead-in and lead-out ramps 48. A drive spring 32 is compressed as the sliding trigger 22 and the revolving member 16 are moved rearwards until such time as the lead-in and lead-out ramps are disengaged from the latch 15 thereby releasing the energy stored in the compressed drive spring 32. As the energy in the drive spring 32 is released the revolving member 16 will move forward and rotate to position the hammer 14 into alignment with the firing pin associated with firing pin assembly 18 positioned adjacent the next barrel to be fired. The firing pin will in turn hit the percussion primer with sufficient force to fire the cartridge 3. A wave spring 30 urges the revolving member 16 rearwards to position the hammer 14 away from firing pin when the revolving member 16 is in a rest position.

The molded barrel member 1 is formed from a rigid material such as, but not limited to, a filled plastic (i.e. glass or nylon fibers). Each barrel of barrel member 1 may optionally include a barrel sleeve 2 that is molded within the barrel member 1. The sleeve 2 is formed from a deformable metal can be made from, but not limited to, 321 stainless steel—seamless mil spec 0.020 inch thickness tubing. Rifling grooves are then added to the metal barrel. Alternatively the metal sleeve can be eliminated and the rifling grooves can be molded directly on to the interior surface of each of the four barrels during the molding process. In either instance the barrel member 1 would not be able to withstand the pressure created by the firing of a conventional round within the weapon.

Typically the cartridge would have a projectile that would weigh 8 to 15 grams and contain 1 to 3 grains of gun powder. The pressure generated within the firing chamber by firing the reduced charge shell cartridge will not exceed 2000 psi. Preferably the reduced shell cartridge will produce a pressure within the firing chamber within the range of 500 to 1000 psi. The muzzle velocity of the projectile leaving the firearm using the reduced charge cartridge will not exceed 600 ft/second. The muzzle velocity will be in the range of 300 to 600 ft/second, preferably approximately 500 ft/second. The cartridge used would preferably be a 45 caliber but other sized cartridges and barrel sizes could be used.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A less than lethal firearm comprising:

a hand gun having a molded barrel member including a plurality of barrels formed as a unitary member, and a main housing supporting said unitary member, each barrel having a muzzle at a distal end and firing chamber at a proximal end, the proximal end of each one of said plurality of barrels being adapted to receive a shell cartridge comprising less than 3 grains of gun powder which can be fired from said hand gun, said unitary member being sufficiently strong to withstand the pressures generated by the firing of said shell cartridge comprising less than 3 grains of gun powder; a sliding trigger mounted for reciprocating movement with said main housing, said sliding trigger including a trigger latch pivotally mounted on said sliding trigger; a revolving member mounted within said main housing, said revolving member having a hammer located thereon, said revolving member being mounted to enable revolving and reciprocating motion such that the hammer will move in a circular path sequentially impacting a firing pin in successive order in response to successive pulls of the sliding trigger, said revolving member includes cam pins that are in operative engagement with slots formed on a stationary helical member.

2. The less than lethal firearm of claim 1, wherein said unitary member will fragment if a standard cartridge is fired therein from one of said plurality of barrels, thereby rendering the firearm unusable to fire a projectile.

3. The less than lethal firearm of claim 1, wherein as said sliding trigger is pulled backwards the trigger latch will catch and then release the revolving mechanism via lead-in and lead-out ramps formed on the revolving member, said less than lethal firearm further including a drive spring that is compressed as the sliding trigger and revolving member are moved backwards until such time as the lead-in and lead-out ramps are disengaged from the trigger latch thereby releasing the energy stored in the compressed drive spring, wherein as the energy in the drive spring is released the revolving member will move forward and rotate to position the hammer in alignment with a firing pin of the next cartridge to be fired.

4. The less than lethal firearm of claim 1, wherein said unitary member is made from a fiber reinforced plastic.

5. The less than lethal firearm of claim 4, wherein rifling grooves are molded into the surface of each of said plurality of barrels.

6. The less than lethal firearm of claim 1, wherein said pressure generated within said firing chamber by firing said reduced charge shell cartridge does not exceed 2,000/psi, preferably in the range of 500 to 1000 psi.

7. The less than lethal firearm of claim 1, wherein the muzzle velocity of said projectile leaving the firearm using said reduced charge shell does not exceed 600ft/ sec, in the range of 300 to 600 ft./second.

8. The less than lethal firearm of claim 1, wherein each of said plurality of barrels has a malleable sleeve molded therein.

9. The less than lethal firearm of claim 8, wherein rifling grooves are cut into the surface of each of said malleable sleeves.

10. A less than lethal firearm comprising:

a hand gun having a molded barrel member including a plurality of barrels formed as a unitary member, and a main housing supporting said unitary member, each barrel having a muzzle at a distal end and firing chamber at a proximal end, the proximal end of each one of said plurality of barrels being adapted to receive a shell cartridge comprising less than 3 grains of gun powder which can be fired from said hand gun, said unitary member being sufficiently strong to withstand the pressures generated by the firing of said shell cartridge comprising less than 3 grains of gun powder; a sliding trigger mounted for reciprocating movement with said main housing, said sliding trigger including a trigger latch pivotally mounted on said sliding trigger; a revolving member mounted within said main housing, said revolving member having a hammer located thereon, said revolving member being mounted to enable revolving and reciprocating motion such that the hammer will move in a circular path sequentially impacting a firing pin in successive order in response to successive pulls of the sliding trigger, said sliding trigger is pulled backwards wherein the trigger latch will catch and then release the revolving mechanism via lead-in and lead-out ramps formed on the revolving member, said less than lethal firearm further including a drive spring that is compressed as the sliding trigger and revolving member are moved backwards until such time as the lead-in and lead-out ramps are disengaged from the trigger latch thereby releasing the energy stored in the compressed drive spring, wherein as the energy in the drive spring is released the revolving member will move forward and rotate to position the hammer in alignment with a firing pin of the next cartridge to be fired.

11. The less than lethal firearm of claim 10, wherein said revolving member includes cam pins that are in operative engagement with slots formed on a stationary helical member.

12. The less than lethal firearm of claim 10, wherein said unitary member is made from a fiber reinforced plastic.

13. The less than lethal firearm of claim 12, wherein rifling grooves are molded into the surface of each of said plurality of barrels.

14. The less than lethal firearm of claim 10, wherein said pressure generated within said firing chamber by firing said reduced charge shell cartridge does not exceed 2,000/psi, preferably in the range of 500 to 1000 psi.

15. The less than lethal firearm of claim 10, wherein the muzzle velocity of said projectile leaving the firearm using said reduced charge shell does not exceed 600ft/ sec, in the range of 300 to 600 ft./second.

16. The less than lethal firearm of claim 10, wherein each of said plurality of barrels has a malleable sleeve molded therein.

17. The less than lethal firearm of claim 16, wherein rifling grooves are cut into the surface of each of said malleable sleeves.

* * * * *